United States Patent [19]

Aplan et al.

[11] 4,239,619

[45] Dec. 16, 1980

[54] PROCESS AND APPARATUS FOR SEPARATING MAGNETIC PARTICLES WITHIN AN ORE

[75] Inventors: Frank F. Aplan, State College, Pa.; Timothy M. Todd, Marietta, Ohio

[73] Assignee: Union Carbide Corporation, New York, N.Y.

[21] Appl. No.: 36,695

[22] Filed: May 7, 1979

Related U.S. Application Data

[63] Continuation of Ser. No. 962,113, Nov. 20, 1978, abandoned, which is a continuation of Ser. No. 811,593, Jun. 30, 1977, abandoned, which is a continuation of Ser. No. 630,440, Nov. 10, 1975, abandoned, which is a continuation-in-part of Ser. No. 489,124, Jul. 17, 1974, abandoned, which is a continuation of Ser. No. 95,447, Dec. 7, 1970, abandoned.

[51] Int. Cl.[3] ..... B03G 1/14

[52] U.S. Cl. ..... 209/214; 209/224; 209/232

[58] Field of Search ..... 209/39, 214, 215, 222, 209/223 RA, 224, 228, 232; 55/3, 110; 210/222

[56] References Cited

U.S. PATENT DOCUMENTS

| | | | |
|---|---|---|---|
| 3,289,836 | 12/1966 | Weston | 209/214 |
| 3,440,585 | 4/1969 | Freeman, Jr. | 335/216 |
| 3,503,504 | 3/1970 | Bannister | 209/223 |
| 3,595,386 | 7/1971 | Hradel | 209/223 X |
| 3,608,718 | 9/1971 | Aubrey, Jr., et al. | 209/214 |
| 3,627,678 | 12/1971 | Marston et al. | 210/222 X |

*Primary Examiner*—William A. Cuchlinski, Jr.
*Attorney, Agent, or Firm*—John R. Doherty

[57] ABSTRACT

A process and apparatus for separating magnetic particles from an ore material whereby an ore material intermixed with a liquid or gaseous carrier is fed through a separating zone acted upon by a magnetic field generated by a superconducting solenoid magnet. During passage through the separating zone, the magnetic particles in the ore material are attracted toward the periphery of the zone while the nonmagnetic particles substantially remain at the center whereupon each is then separately collected by mechanical means.

13 Claims, 3 Drawing Figures

FIG. 1
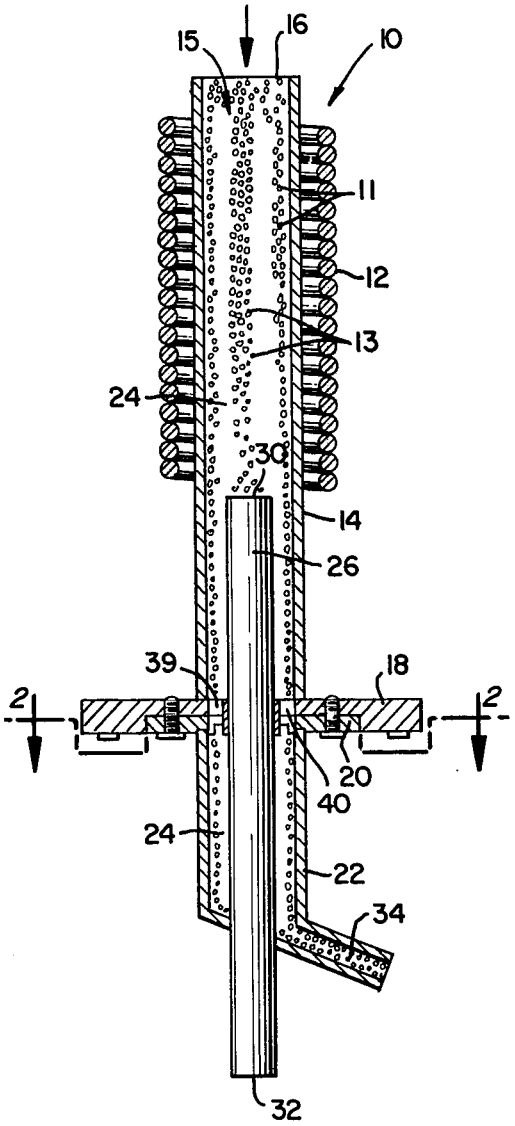
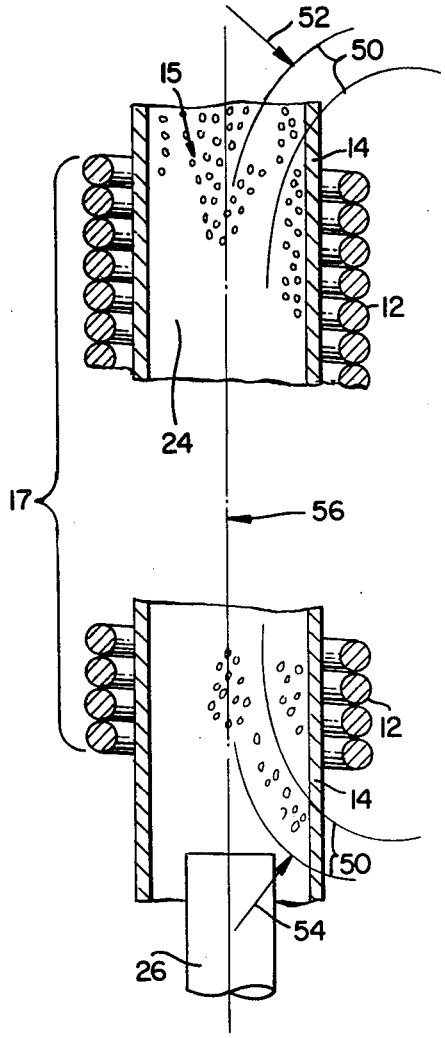
FIG. 3
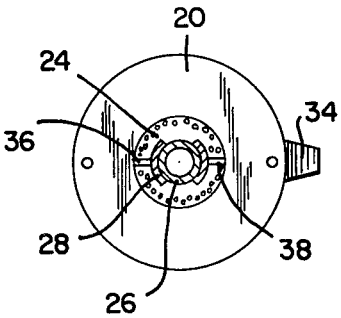
FIG. 2

PROCESS AND APPARATUS FOR SEPARATING MAGNETIC PARTICLES WITHIN AN ORE

This application is a continuation of our prior U.S. application Ser. No. 962,113 filed Nov. 20, 1978 which is a continuation of application Ser. No. 811,593 filed June 30, 1977 which is a continuation of application Ser. No. 630,440 filed Nov. 10, 1975 which is a continuation-in-part of application Ser. No. 489,124 filed July 17, 1974 which is a continuation of application Ser. No. 095,447 filed Dec. 7, 1970. The following five applications are now abandoned: Ser. Nos.: 811,593; 630,440; 489,124; and 095,447 and 962,113.

FIELD OF THE INVENTION

The invention relates to a process and apparatus for separating magnetic particles from an ore material by use of a superconducting magnet.

DESCRIPTION OF THE PRIOR ART

A wide variety of metallurgical processes are employed to separate valuable metals or other constituents from various materials. One area of recent activity has been directed to the use of permanent and electromagnetic separators, such as wet drum magnetic separators, for this purpose. The most widely employed system of this type used for the wet separation of ores are capable of achieving only relatively low magnetic field strengths (i.e., 1200 to 2500 gauss magnitude) and are therefore useful only with strongly magnetic materials. Other systems using dry magnetic separators, such as the cross-belt and induced roll separators, are capable of field strengths up to 18,000 gauss but are expensive to manufacture and costly to operate due to low workload capacity. Although other high field strength magnetic systems have been developed for wet separation applications, they have been found generally inadequate for commercial use when processing low value ores since the systems cannot provide the high volume throughput of ore necessary for economically separating the valuable metals contained therein. Therefore, other separation processes, such as the flotation process, have been resorted to for processing these low value ores.

A system which is capable of generating high intensity magnetic field strengths is required in the separation of very weakly-magnetic particles from ore materials, such as "non-magnetic" (also referred to as feebly magnetic) iron ores and weakly paramagnetic materials from diamagnetic materials. Thus a method which combines the use of a high intensity field with an ability to continuously process large quantities of ore material is greatly needed in industry. It is the object of this invention to provide both a method and apparatus for accomplishing this.

SUMMARY OF THE INVENTION

Broadly, this invention relates to a method and apparatus for separating valuable magnetic metals or magnetic minerals from an ore material on a continuous basis. Specifically, a process whereby an ore material, preferably mixed with a liquid or gaseous carrier, is fed through a hollow member having a zone, which is acted upon by a magnetic field produced by a surrounding superconducting solenoid magnet having a field strength and field gradient such that the more magnetic particles within the ore drawn to the periphery of the hollow member in the regions at the entrance and exit of the zone while the less magnetic particles remain substantially in the center of the zone. The adjustment of both the field strength and field gradient can be accomplished without the addition of component parts placed in the hollow member as is usually the situation when using conventional iron type magnets. After passage of the ore from the unobstructed zone, a mechanical interceptor adjacent, e.g. below the confined zone separates the magnetic particles from the non-magnetic particles whereupon each is then suitably collected. A magnetic field strength in excess of about 15,000 gauss, and often in excess of 20,000 gauss, is generally required for processing low value ores. This high field strength is easily obtainable with the use of superconducting magnets which have recently undergone important technical improvements. These magnets exhibit an abrupt and large increase in electrical conductivity as their operating temperatures approach absolute zero, such temperatures being usually between about 0.5° K. and about 18° K. and preferably between about 3.0° K. and about 6.0° K.

Superconducting magnets have been made by winding wire or tape into an inductive configuration. More recent developments, however, include the fabrication of such a magnet by superimposing layers containing a superconducting material alternately with layers composed of a nonsuperconducting material. The superconducting layers each comprises a structure of microscopic particles bonded into interlocking relation, the interface between bonded particles forming a continuous matrix of metallic material having superconducting properties. A number of metallic materials are suitable for use in this type of superconducting magnet, i.e., niobium, tin, zirconium, aluminum, vanadium and silicon. The intervening nonsuperconducting layers are each preferably composed of a normally conductive material, such as copper, and an electrical insulator, such as alumina. Because of the capability in fabricating these layers in various geometric shapes, as described in U.S. Pat. Nos. 3,407,049 and 3,440,585 titled "Superconducting Articles and Method of Manufacture", and "Superconducting Magnets", respectively, a superconducting magnet can be fabricated with almost any geometrical configuration. For the purpose of this invention, a cylindrical solenoid configuration is preferably employed.

The carrier medium employed in this invention to convey the ore material through the magnetic field is preferably a nonreactive liquid or gas such as water or air, respectively. Other inert gases, such as argon, nitrogen, helium and the like, can also be satisfactorily employed in this invention. The carrier medium is intended primarily to be a vehicle for the ore material so that the ore can be gravity fed and/or pumped through the confined zone in a stream-like manner whereupon the magnetic field in the zone can act upon the ore to separate the magnetic from the nonmagnetic particles contained therein. Nonmagnetic particles are intended to mean particles less magnetic than the magnetic particles desired to be separated from the ore. After substantial magnetic separation of the particles has occurred, the carrier medium is mechanically divided into two segments, one containing the magnetic particles and the other containing the nonmagnetic particles. Thereafter the magnetic particle-containing segment of the carrier medium is suitably collected and further processed by conventional means to extract the valuable metals and/or minerals contained therein. The velocity of the ore-containing carrier medium through the magnetically confined zone is variable and will depend, among other things, on the size of the confined zone, the density of the magnetic particles within the ore, the size of the particles being treated and the field strength and field gradient of the magnetic field employed. Generally the velocity should be adjusted so that the magnetic field will have sufficient time to substantially separate the magnetic particles from the non-magnetic particles in the ore-containing carrier medium before the medium is mechanically divided and thereafter separately collected. It is also possible to vary the location and size of the mechanical divider means within the magnetically confined zone to correlate with the magnetic particle density and size, carrier medium velocity flow, and magnetic field and gradient strength so that substantially all the magnetic particles will be attracted to the peripheral area of the zone prior to arriving at the mechanical divider.

The exact particle size of the ore being treated can vary substantially since it depends on the particular field strength, field gradient, flow rate, carrier medium and apparatus configuration employed. Although a particle size of 10 Tyler mesh and finer has been found desirable, a narrow range of particle sizes is preferable. For example, the size of coarse particles larger than 100 Tyler mesh should be limited whereby the largest particle is no greater in size than about 3 times the size of the smallest particle. The size variations of fine particles smaller than 100 Tyler mesh can vary widely although a 15 to 1 ratio between the largest size particle and the smallest size particle is preferable.

DESCRIPTION OF THE DRAWING

The invention will be more readily understood by referring to the drawing wherein FIG. 1 is a vertical view, partly in section, of an apparatus which is suitable for implementing the invention.

FIG. 2 is a cross sectional view of the apparatus in FIG. 1 taken along lines 2—2.

FIG. 3 represents a portion of the apparatus of FIG. 1 and indicates the magnetic flux pattern developed with the apparatus.

DESCRIPTION OF THE PREFERRED EMBODIMENTS

Referring to the drawing there is illustrated an apparatus 10 which includes a superconducting solenoid magnet 12 surrounding a hollow tube 14 having an inlet opening 16 at the upper portion thereof through which the ore-containing carrier medium 15 is fed. Tube 14 is secured to a flange plate 18 which in turn is affixed to plate 20, both plates of which are provided with concentric openings to effect a continuous feed through opening during the operational mode of the system. A second tube 22 attached to plate 20 is aligned with tube 14 to provide in effect a continuous shaft 24 through which the magnetic ore-containing carrier medium at the peripheral area of tube 14 can pass unimpeded. Thin radial rods 36 and 38 on plate 20 and radial rods 39 and 40 on flange 18 provide the only impedance to the flow of material through shaft 24. A smaller cylindrical tube 26 is centered in shaft 24 below the end of superconducting solenoid magnet or by means of sleeve 28, which abuts rods 39 and 40 on flange 18. This tube has an opening 30 at open end and an exit orifice 32 at the other end through which the nonmagnetic, ore-containing carrier medium occupying the central area of tube 14 can pass. The magnetic, ore-containing carrier medium passing through shaft 24 is directed by tube segment 22 onto angled channel 34 from which it is appropriately discharged and collected by suitable means not shown.

FIG. 2 illustrates the internal structure of plate 20, tube 26 and channel 34 in greater detail. Sleeve 28 is rigidly secured to plate 20 by support rods 36 and 38. Although sleeve 28 is shown as being in the form of two semi-circular segments, a unitary structure of virtually any shape would be satisfactory provided it did not unduly impede the flow of the magnetic, ore-containing carrier medium.

In carrying out the invention, ore material mixed with a carrier medium, such as air or water, is pumped and/or gravity fed through opening 16 into tube 14. Simultaneously, superconducting solenoid magnet 12 is energized by conventional means (not shown) to create a magnetic field in the path of ore travel and magnetic field gradients in the regions adjacent the ends of superconducting solenoid magnet 12 where the ore enters and exits the confined zone 17 surrounded by the superconducting solenoid magnet 12. The field strength and field gradient are adjusted for the particular particle or range size of the ore being treated, the carrier medium employed, the density of the magnetic particles to be separated and the flow rate the ore-containing medium is to be fed through the zone. The magnetic particles 11 in the ore-containing carrier medium 15 are attracted to the periphery of shaft 24 toward the inner wall of tube 14 substantially only at locations adjacent the upper and lower end portions of superconducting solenoid magnet 12 as hereinafter described in conjunction with FIG. 3; the nonmagnetic particles 13 contained therein, are unaffected by the magnetic field of superconducting solenoid magnet 12 and therefore remain substantially at the center of tube 14. Mechanical separation is affected by tube 26 which is below the exit end of superconducting solenoid magnet 12 and designed to collect the nonmagnetic particle-containing carrier medium while allowing the magnetic particle-containing carrier medium to pass unimpeded. Depending on the nature of the ore to be treated and on the magnitude and configuration of the magnetic field produced by the superconducting magnet 12, tube 26 can be adjusted vertically along the longitudinal axis of shaft 24 and/or the diameter can be varied so that it will be in an optimum position for collecting the ore-containing carrier medium at the center of the shaft. Thus opening 30 of tube 26 is positioned proximate the lower portion of the superconducting magnet 12 so as to be in a position for immediately collecting the separated nonmagnetic particle-containing carrier medium. In this manner efficient separation of the particles is quickly accomplished.

With reference to FIG. 3, which represents a portion of the apparatus of FIG. 1, the solenoid superconducting magnet 12 develops a flux pattern characteristic of solenoid magnets as indicated at 50. The magnetic field gradient forces in the region in the vicinity of the upper, i.e. entrance portion of superconducting solenoid magnet 12 are indicated at 52. The magnetic field strength of superconducting solenoid magnet 12 is adjusted to a suitable value, e.g. 15,000 gauss or higher and thus a strong magnetic field exists together with a substantial magnetic field gradient in the region adjacent the entrance portion of superconducting solenoid magnet 12 which surrounds zone 17. Thus the magnetic field gradient forces indicated at 52 are substantial, being the product of field strength (H) and magnetic field gradient dH/dr (distance). Consequently, magnetic particles 11 in the ore-containing carrier medium 15 are directed toward the inner wall of tube 14 in the region adjacent the upper end of superconducting solenoid 12. In the central region 56 within zone 17 surrounded by superconducting solenoid magnet 12, the magnetic field gradient dH/dr is minimal, as is the case with solenoid magnets, and there is substantially no separation of magnetic particles in this central region since the magnetic force, H·(dH/dr), is minimal. In the region adjacent the lower, i.e. exit portion of superconducting solenoid magnet 12, the magnetic field gradient forces indicated at 54 are substantial, and comparable to forces 52 in the entrance region, and additional magnetic particles remaining in the ore-containing carrier medium 15 are directed toward the periphery of shaft 24 toward the inner wall of tube 14. Thus, in the present invention, magnetic separation occurs substantially in the regions where the ore-containing carrier medium enters and exits the zone 17 enclosed by the surrounding superconducting solenoid magnet 12.

In the present invention, through the use of a superconducting solenoid magnet 12, very strong magnetic fields can be achieved since superconducting magnets are not limited by magnetic saturation of core materials, as are conventional electromagnets, and the strong magnetic fields obtained enable magnetic separation in regions of substantial field gradients adjacent the ends of a superconducting solenoid electromagnet. The use of a solenoid arrangement in the present invention permits the processing of large throughput volumes of weakly magnetic ores since the zone confined by the superconducting solenoid is unrestricted by magnetic or collecting devices.

The process of the invention can be optimized by properly selecting the system component variables. For example, better movement of the ore particles within the carrier medium can be obtained by using a relatively low effective viscosity carrier medium and/or separating the ore particles into various sizes prior to processing them according to the invention. Thus the magnetic field strength and field gradient can be adjusted to accommodate the particular particle sizes in the ore so that the magnetic particles can be separated from the nonmagnetic or less magnetic particles efficiently and effectively. A suitable ore-containing carrier medium can be prepared by maintaining the concentration of the ore material in the carrier medium at reasonably low levels but not so low as to seriously effect the throughput rate of the ore through the magnetic field, such magnetic field being preferably greater than about 25,000 gauss. The field gradient can be accentuated and localized by introducing a Maxwell pair into the system to modulate the field generated by the superconducting magnet. Greater separation of particles can be obtained if the nonmagnetic particle-containing carrier medium collected in tube 26 is recycled, at least once, back into the same or a different separator. This can be accomplished by either adding parallel connected separators or by modifying the original separator by adding feedback means whereby the output from tube 26 can be fed back into the system.

It is advisable, and in some cases necessary, to remove particles of high magnetic susceptibility from the ore material by conventional magnetic separator means prior to feeding the ore material into the separator of the invention so as to prevent highly magnetic particles from becoming attached to the inner wall of the tube in the separating zone. This attraction and buildup of highly magnetic particles on the inner wall would retard and restrict the free flow of the ore-containing carrier medium through the separator. In treating an ore-containing carrier medium having particles with widely different magnetic susceptibility, it would be advisable to arrange a system composed of a series of magnetic separators each having a different field strength and field gradient so that each would attract particles of different magnetic susceptibility.

The hollow tube 14 and to a lesser extent the tube 26 must be composed of a material which will not adversely affect the magnetic field strength of the system. Materials such as brass, copper, aluminum and the like are quite suitable.

The invention will be further illustrated by the following example:

EXAMPLE

A brass tube 27 inches long and having an inner diameter of 1.3 inches was placed within the center part of a substantially cylindrical superconducting solenoid magnet. The magnet was 8.75 inches long and 6 inches in diameter and was constructed of niobium tin windings. The magnet assembly was immersed in liquid helium (below 4.6° K.) in a specially designed cryogenic dewar flask. A second brass tube 2.5 inches long with an inside diameter of 1.0 inch was positioned within the larger tube just below the lower part of the superconducting magnet. A feebly magnetic iron ore consisting primarily of goethite and quartz was crushed so that the particles could pass through a 28 Tyler mesh screen and finer. A slurry of water and the crushed iron ore was gravity fed into the larger brass tube thereby passing through the magnetic field set up by the superconducting magnet. The magnetic field strength was set at approximately 15,000 gauss for this ore and the iron mineral, goethite, contained therein was readily recovered during the process as described above. Two passes were made through the separator with the following results. The magnetic particle-containing slurry from the second pass, referred to as the concentrate, was analyzed and found to contain 41.1% iron. The nonmagnetic particle-containing slurry from the second pass, referred to as the middlings, was found to contain 32.6% iron while the nonmagnetic particle-containing slurry from the first pass, referred to as the tailings, analytically revealed a 14.3% iron content. The overall recovery of iron from the concentrate plus the middlings was 83%.

Using the same ore material, but limiting the particle size to between 28 Tyler mesh size and 48 Tyler mesh size, and following the same procedure as above, a concentrate was produced which upon analysis showed it to contain 43.8% Fe. An analysis of the middlings and tailings revealed an iron content of 28.3% and 4.7%, respectively. The overall recovery of iron from the concentrate plus the middlings using this closer particle size range was 93.5%. Thus by regulating the particle size, the recovery of iron was improved.

Concentrate grade and recovery could also be improved by optimizing the field strength and field gradient and/or by using a multiple of passes through the separator.

A large number of ore materials can be processed according to the invention as long as the metal or mineral to be recovered is susceptible to magnetic influence. Some typical examples of materials that can be separated from ore according to this invention include carnotite, chromite, garnierite, goethite, hematite, ilmenite, monazite, rhodochrosite, mangano-dolomite, and siderite from their less magnetic gangue particles as well as manganese dioxide mainerals, molybdenum oxide minerals, vanadium bearing minerals, iron minerals, columbium minerals and tungsten minerals from their respective ores, pyrite from coal and a non-mineral chromium carbide from slag.

The above example illustrates only one embodiment of the invention and many modifications are possible without departing from the scope of the invention.

What is claimed is:

1. A process for separating magnetically susceptible particles from nonmagnetically susceptible particles within an ore material comprising:

(a) adding the ore material in a particulate form to a carrier medium;

(b) passing the ore containing carrier medium through an unobstructed confined zone surrounded by a superconducting solenoid magnet which provides a magnetic field in excess of about 15,000 gauss generated by said superconducting solenoid magnet such that essentially no magnetic field gradient forces are provided in said confined zone while substantial magnetic field gradient forces are provided only in the end regions outside said confined zone which are adjacent the entrance and exit of said zone and such that said magnetically susceptible particles within the ore are separated from said nonmagnetically susceptible particles only in said end regions where said ore enters and exits said confined zone; and (c) mechanically separating the peripheral magnetic particles in the ore-containing carrier medium from the central nonmagnetic particles in said carrier medium only in said end region adjacent said confined zone.

2. The process as in claim 1 wherein the particle size of the ore material in the particular form in step (a) is less than about 10 Tyler mesh.

3. The process as in claim 1 wherein the particle size of the ore material in the particular form in step (a) is larger than about 100 Tyler mesh and has no particles larger than about 3 times the size of the smallest particle.

4. The process as in claim 1 wherein the particle size of the ore material in the particular form in step (a) is smaller than about 100 Tyler mesh.

5. The process as in claim 4 wherein the particle size of the ore material in the particular form in step (a) is smaller than about 100 Tyler mesh and has no particles larger than about 15 times the size of the smallest particle.

6. The process as in claim 1 wherein the magnetically susceptible particles to be separated from an ore material are selected from the group consisting the carnotite, chromite, garnierite, goethite, hematite, ilmenite, monazite, rhodochrosite, mangano-dolomite, and siderite from their less magnetic gangue particles as well as manganese dioxide minerals, molybdenum oxide minerals, vanadium bearing minerals, iron minerals, columbium minerals and tungsten minerals from their respective ores, pyrite from coal and a non-mineral chromium carbide from slag.

7. The process as in claim 1 wherein the carrier medium is selected from the group consisting of water, air, argon, nitrogen and helium.

8. The process as in claim 1 wherein in step b) said confined zone is a cylindrical zone and said ore-containing carrier medium is gravity fed through said cylindrical zone.

9. The process as in claim 1 wherein in step b) said confined zone is a cylindrical zone and said ore-containing carrier medium is pumped through said cylindrical zone.

10. The process as in claim 1 wherein the central nonmagnetic particles in the ore-containing carrier medium are recycled by passing the nonmagnetic particles through the same or a different confined zone surrounded by a superconducting magnet together with the carrier medium.

11. An apparatus for separating magnetically susceptible particles within an ore material comprising a first hollow member defining a confined zone therein; a super-conducting magnetic means disposed along a portion of the axial length of said first hollow member whereby a magnetic field is generated in relation to said confined zone such that essentially no magnetic field gradient forces are provided in said confined zone while at the same time substantial magnetic field gradient forces are provided only in the end regions outside said confined zone which are adjacent the entrance and exit of said confined zone and such that said magnetically susceptible particles within the ore are separated from the nomagnetically susceptible particles in the ore only in said end regions where the ore enters and exits said confined zone; a second hollow member smaller than and concentrically disposed within said first hollow member and axially positioned below said magnetic field; and means for directing the output from said first and said second hollow members in separate directions.

12. The apparatus of claim 11 wherein said hollow members are cylindrical members.

13. The apparatus of claim 12 wherein means are added for diverting at least a portion of the output from the second cylindrical member back into the first cylindrical member.

* * * * *